US010105730B2

(12) United States Patent
Guzowski

(10) Patent No.: US 10,105,730 B2
(45) Date of Patent: Oct. 23, 2018

(54) ROBOTIC CARTRIDGE DISPENSER AND METHOD

(71) Applicant: Fanuc America Corporation, Rochester Hills, MI (US)

(72) Inventor: Raymond J. Guzowski, Fenton, MI (US)

(73) Assignee: FANUC AMERICA CORPORATION, Rochester Hills, MI (US)

( * ) Notice: Subject to any disclaimer, the term of this patent is extended or adjusted under 35 U.S.C. 154(b) by 80 days.

(21) Appl. No.: 14/495,276

(22) Filed: Sep. 24, 2014

(65) Prior Publication Data

US 2015/0086706 A1 Mar. 26, 2015

Related U.S. Application Data

(60) Provisional application No. 61/881,794, filed on Sep. 24, 2013.

(51) Int. Cl.

| | |
|---|---|
| ***B05C 11/10*** | (2006.01) |
| ***B05C 11/11*** | (2006.01) |
| ***B05B 12/14*** | (2006.01) |
| ***B05C 5/02*** | (2006.01) |

(52) U.S. Cl.

CPC ..... *B05C 11/1036* (2013.01); *B05B 12/1463* (2013.01); *B05C 5/0216* (2013.01); *B05C 11/1007* (2013.01); *B05C 11/11* (2013.01); *Y10S 901/09* (2013.01)

(58) Field of Classification Search

CPC . B05C 11/1007; B05C 11/1036; B05C 11/11; B05B 12/1463

See application file for complete search history.

(56) References Cited

U.S. PATENT DOCUMENTS

| | | | | |
|---|---|---|---|---|
| 6,001,181 | A * | 12/1999 | Bullen | 118/679 |
| 6,071,346 | A * | 6/2000 | Yamauchi et al. | 118/668 |
| 6,338,441 | B1 * | 1/2002 | Umezawa | B05B 3/1064 239/104 |
| 6,739,111 | B2 | 5/2004 | Banks et al. | |
| 6,908,642 | B2 | 6/2005 | Hubert | |
| 7,112,246 | B2 | 9/2006 | Schucker | |
| 7,421,831 | B2 | 9/2008 | Neeper et al. | |
| 7,641,461 | B2 | 1/2010 | Khoshnevis | |
| 2002/0081386 | A1 * | 6/2002 | Yoshida et al. | 427/401 |
| 2006/0096254 | A1 | 5/2006 | Rogers | |

(Continued)

*Primary Examiner* — Michael P. Rodriguez

(74) *Attorney, Agent, or Firm* — William J. Clemens; Shumaker, Loop & Kendrick, LLP

(57) ABSTRACT

A system for applying sealant material from a cartridge includes a cartridge fixture storing a plurality of cartridges each cartridge including unique identification information and containing sealant material, a cartridge robot for removing a selected one of the cartridges from the fixture, and a dispense robot for receiving the selected cartridge from the cartridge robot and applying the sealant material contained therein to a workpiece. A controller is connected to the cartridge robot and the dispense robot for operating the robots and a plurality of sensors are connected to the controller for generating the unique identification information for the selected cartridge, sealant usage per workpiece, sealant dispense pressure, sealant dispense temperature; and sealant usage from the selected cartridge.

16 Claims, 5 Drawing Sheets

(56) References Cited

U.S. PATENT DOCUMENTS

| | | | | |
|---|---|---|---|---|
| 2006/0225489 | A1* | 10/2006 | Giles et al. | 73/64.53 |
| 2010/0108558 | A1 | 5/2010 | Zook et al. | |
| 2010/0291310 | A1 | 11/2010 | Hartmann et al. | |

* cited by examiner

ROBOTIC CARTRIDGE DISPENSER AND METHOD

This application claims the benefit of U.S. provisional patent application Ser. No. 61/881,794 filed Sep. 24, 2013.

FIELD OF THE INVENTION

This invention relates to an apparatus and method for dispensing sealant from cartridges. More particularly, the invention is directed to an apparatus and method for applying sealants or adhesives in any industry where cartridges are used to apply the material.

BACKGROUND OF THE INVENTION

This section provides background information related to the present disclosure which is not necessarily prior art.

In the aerospace and other manufacturing industries, the prior art uses the same pre-mixed two component cartridges or one component cartridges and air actuated dispense guns manipulated by people to apply sealants in the assembly process. For example, single acting shot meters use a displacement rod to control the application of sealer being pumped from a supply pump to a dispense gun. Robots use vision to locate the car body or seams on the car body to precisely locate the seams for sealer application.

Shortcomings of this prior art are:

Meter mixing equipment cannot guarantee the proper mix ratio during application.

Requires operator handle cartridges and apply sealer on large parts that are hard to reach resulting in significant human labor to apply sealers.

Operator fatigue and ergonomic constraints increase the chance of misapplied sealer.

Pneumatic applicators use compressed air to dispense sealer relying on operator technique to provide an acceptable application.

Air driven applicators have variability due to variations in molded cartridges, application temperature and changing viscosity of the material due to work life, and open time.

Disposable nozzles are not very dimensionally repeatable for use in a robotic application.

Human inspection of sealer applications on larger parts can be tedious and can result in operators unintentionally overlooking small areas potentially missing misapplied sealer application.

BRIEF SUMMARY OF THE INVENTION

This invention over comes prior art by using precise servo control apparatus to dispense sealer from adhesive and sealant cartridges previously using manual or air driven caulking guns. The apparatus and method according to the invention provides precise dispensing starts and stops, precise material flow control, and pressure/temperature/time monitoring of each cartridge that assures proper usage of material.

The system according to the invention includes a cartridge/tip fixture, a cartridge/tip robot, a cartridge dispense robot and a controller with a GUI for controlling the robots according to a method to apply sealer material from cartridges. The method includes:

Loading pre-mixed cartridges into a cartridge/tip fixture.

Tracking the time each cartridge has been in each position in the fixture.

The fixture monitors and controls the temperature of the cartridges.

Time and Temperatures are recorded at the GUI for record keeping.

The fixture also holds a number of disposable nozzles that the dispense robot will need to apply sealer in the desired areas of the part being processed.

The cartridge/tip robot removes the nozzle and/or old cartridge from the dispense robot in preparation for the next dispense application.

The cartridge/tip robot installs the desired nozzle in the dispense robot in preparation of the next dispense application.

The cartridge/tip robot picks the desired cartridge in preparation of the next dispense application by identifying the bar code on the cartridge for record keeping at the GUI.

The cartridge/tip robot installs the desired cartridge in the dispense robot in preparation for the next dispense application.

The dispense robot inspects the nozzle using a vision function.

Tool adjustments are recorded at the GUI for record keeping.

The dispense robot moves to the part and finds the part using vision.

The dispense robot applies sealer to the part while tracking: sealer usage per job/part; sealer dispense pressure; sealer dispense temperature; and sealer usage from each cartridge.

Automatically changing to a new cartridge when current cartridge is empty.

The dispense robot or an inspection robot moves a vision sensor to error proof the sealer application.

Provides inspection results and optional inspection images for record keeping.

DESCRIPTION OF THE DRAWINGS

The above as well as other advantages of the present invention will become readily apparent to those skilled in the art from the following detailed description of a preferred embodiment when considered in the light of the accompanying drawings in which.

DESCRIPTION OF THE PREFERRED EMBODIMENT

The U.S. provisional patent application Ser. No. 61/881,794 filed Sep. 24, 2013 is incorporated herein by reference.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
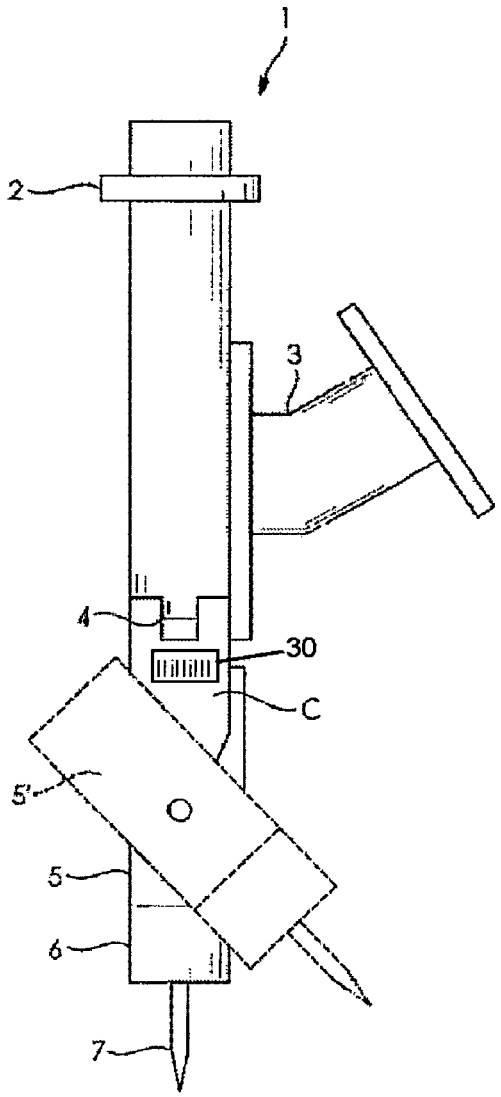
FIG. 1 is a schematic view of a servo controlled sealant dispenser according to the invention.

A servo controlled sealant dispenser 1 according to the invention is shown in FIG. 1. The dispenser 1 shown in FIG. 1 is a mechanical actuator having the following features:

A servo actuator 2 to push a plunger in a cartridge C to dispense material mounts to a robot via a bracket 3 and provides mounting and support for a cartridge holder 5.

A cartridge plunger actuator 4 provides a sensing function when the actuator and the cartridge plunger are engaged, has a gripping device for firmly holding the cartridge plunger to the actuator, and releases from the cartridge plunger for cartridge changing.

The cartridge holder 5 (solid lines representing the closed position) opens to facilitate cartridge changing with a pneumatic actuator or mechanical actuator tied to the plunger actuator 4 to position the holder 5' (broken lines representing the open position) for changing and with quick change mounting to the servo actuator 2.

A pressure sensing manifold 6 has a quick change connection to the cartridges C, a disposable isolation chamber to accommodate curing materials, a quick change mounting to the cartridge holder 5, a 0-300 psi to 4-20 ma pressure sensor, and a quick change connection for disposable nozzles 7.

The robot mounting bracket 3 holds a vision sensor mounting, and provides cable routing and support for servo motor cables, pressure sensor cables and vision sensor cables.

Figure 2:
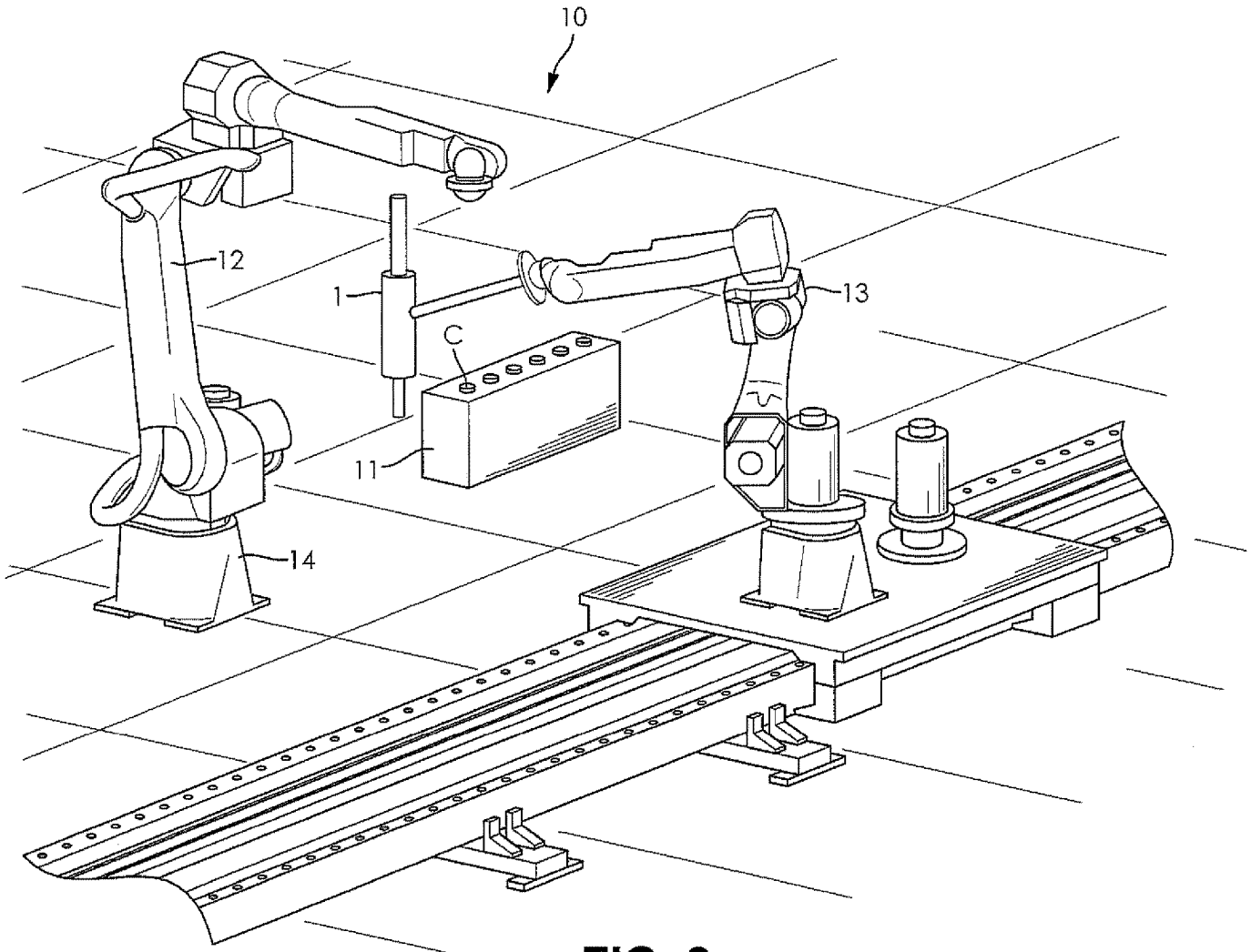
FIG. 2 is a perspective of a robotic system according to the invention including a cartridge/tip manager robot and a cartridge dispenser robot.
Figure 3:
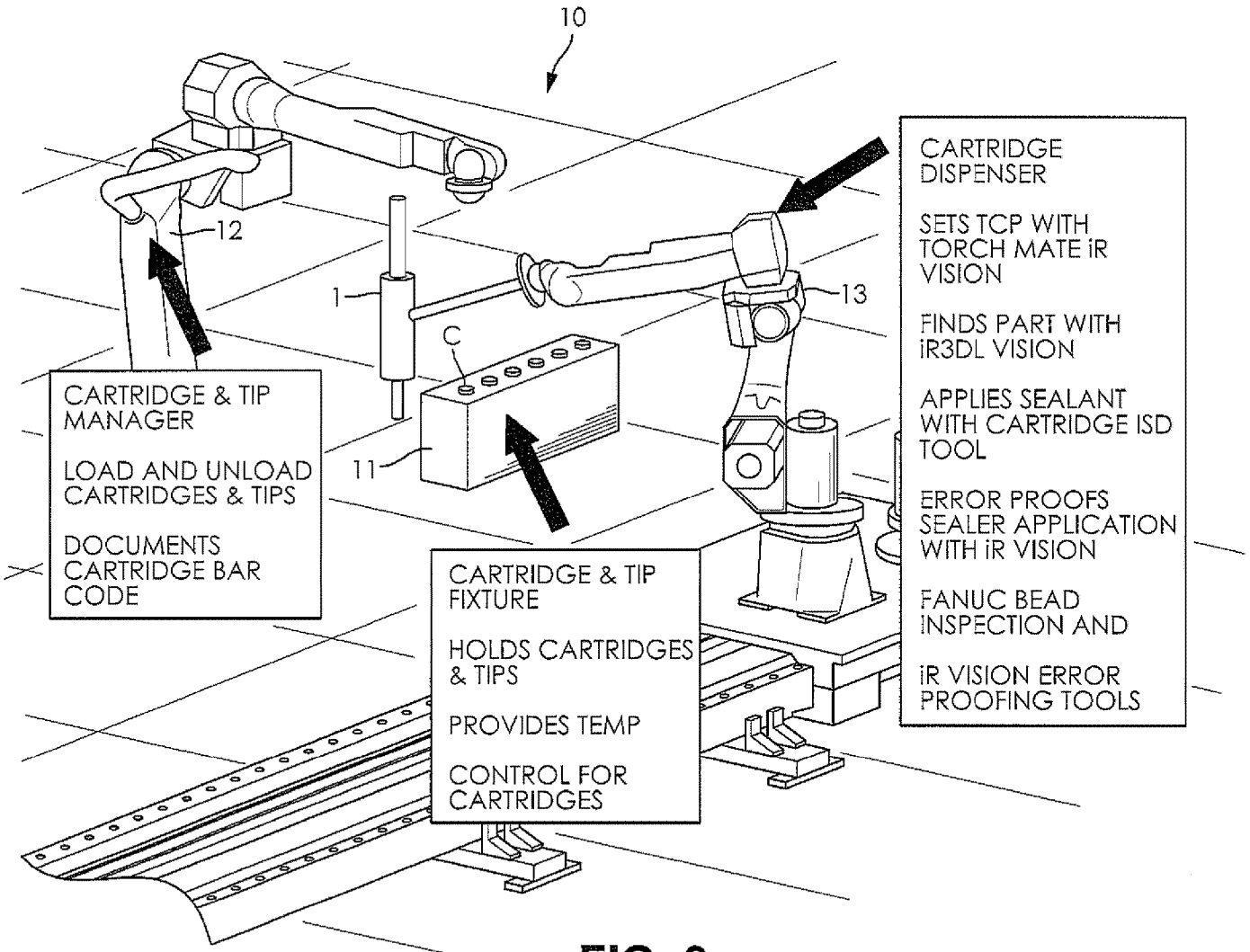
FIG. 3 is similar to FIG. 2 with the method steps according to the invention illustrated.

As shown in FIG. 2, the apparatus according to the invention is a robotic system 10 that includes a cartridge/tip fixture 11, a cartridge/tip manager robot 12, a cartridge dispenser robot 13 and a controller 14 with a graphical user interface (GUI) for controlling the robots according to the inventive method to apply sealer material from cartridges. FIG. 3 is the same view as FIG. 2 with explanatory text describing the method steps.

Figure 4:
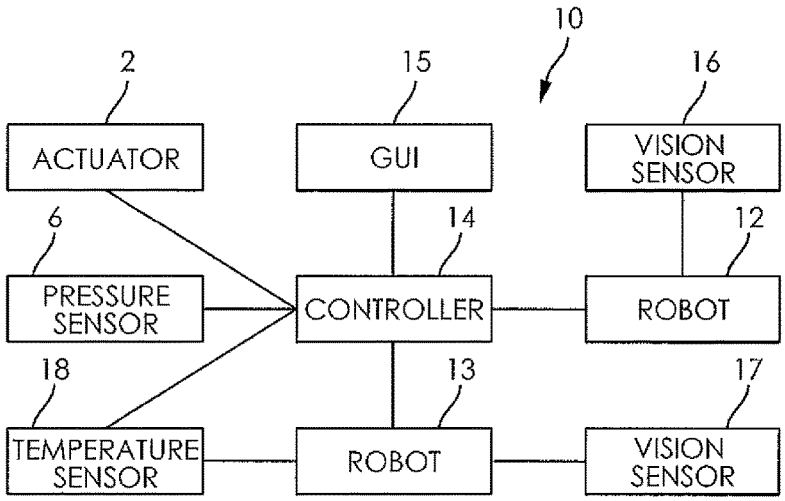
FIG. 4 is a block diagram of the robotic system shown in FIGS. 2 and 3.

FIG. 4 is a block diagram of the robotic system 10 shown in FIGS. 2 and 3. The servo actuator 2 and the pressure sensor 6 are connected to the controller 14 for controlling the servo actuator and receiving pressure information from the sensor. The controller 14 is connected to the cartridge/tip manager robot 12 and to the cartridge dispenser robot 13 for sending control signals to the robots and for receiving signals from various sensors representing operational data such as temperature, pressure, speed and position. The controller 14 can be a single controller or a separate controller for each robot networked together. The cartridge/tip manager robot 12 has a vision sensor 16 for sending vision signals to the controller 14. The cartridge dispenser robot 13 has a vision sensor 17 for sending vision signals to the controller 14. A GUI 15 is connected to the controller as is a temperature sensor 18 incorporated in the cartridge/tip fixture 11. The GUI 15 displays system operating data to the user and accepts user commands. The sensor 18 provides information related to the temperature of the cartridges C to the controller 14.

The cartridge/tip fixture 11 releasably retains a plurality of the cartridges C and the tips 7. The method and apparatus according to the invention includes automated cartridge handling that provides controlled usage of cartridges and automated tracking of: sealer batch numbers, assemblies being processed, open time for cartridges to be used, temperature control of the material in the cartridges, and automated record keeping. The temperature control of the material extends the useful life and improves application consistency. The automated record keeping involves records of each cartridge used, each application and each part sealed. The cartridge dispensing apparatus may also be loaded manually when the cartridge management robot system is not used.

Using the robotic cartridge dispenser apparatus and method according to the invention provides: precise starts and stops; precise flow control; pressure/temperature/time monitoring of each cartridge that assures proper usage of material; correct nozzle for each application; precise robot tool adjustment for each new nozzle; improved precision of sealer application; a controlled inspection program to assure proper sealer application; and automated record keeping for each inspection.

The method according to the invention includes a process for robotically applying pre-mixed sealer material supplied in cartridges, The method includes the following steps (see FIG. 3):

Pre-mixed or single component cartridges C are loaded into the cartridge holding fixture 11. The system 10 tracks the time each cartridge has been in each position in the fixture. The fixture 11 monitors and controls the temperature of the cartridges C. Time and temperatures are recorded at the GUI 15 for record keeping. The fixture 11 also holds a number of the disposable nozzles 7 that the robot will need to apply sealer in the desired areas of the part being processed.

The cartridge/nozzle changer or manager robot 12 removes the nozzle 7 and/or the old cartridge C from the dispense robot 13 in preparation for the next dispense application. An operator could also remove the nozzle 7 when the cartridge management system is not used.

The cartridge/nozzle changer or manager robot 12 installs the desired nozzle 7 in the dispenser robot 13 in preparation of the next dispense application. An operator could also install the desired nozzle 7 when the cartridge management system is not used.

The cartridge/nozzle changer or manager robot 12 picks the desired cartridge C for performing the following steps with the dispenser robot 13. In preparation of the next dispense application it identifies the bar code on the cartridge C for record keeping at the GUI 15. The cartridge/nozzle changer or manager robot 12 uses the vision sensor 16 to read the bar code 30 (Fig.1) on the cartridge C. The bar code 30 contains unique identification information for the associated cartridge C. An operator could also pick the desired cartridge C when the cartridge management system is not used.

The cartridge/nozzle changer or manager robot 12 installs the desired cartridge C in the dispenser robot 13 in preparation for the next dispense application. An operator could also install the desired cartridge C when the cartridge management system is not used.

The dispense robot 13 inspects the nozzle 7 using a vision function of the vision sensor 17, and tool adjustments are recorded at the GUI 15 for record keeping.

The dispense robot 13 moves to the part and finds the part using the vision sensor 17. The part can also be fixtured relative to the robot when vision is not used.

The dispense robot 13 applies sealer to the part and tracks sealer usage per job/part, sealer dispense pressure, sealer dispense temperature, and sealer usage from each cartridge C. The dispense robot 13 automatically changes to a new cartridge when the current cartridge is empty. The robot 13 uses a program that tracks sealer remaining in the cartridge, and the sealer volume required for the next part.

The dispense robot 13 or an inspection robot (not shown) moves a vision sensor to error proof the sealer application and provides inspection results and optional inspection images for record keeping.

Figure 5:
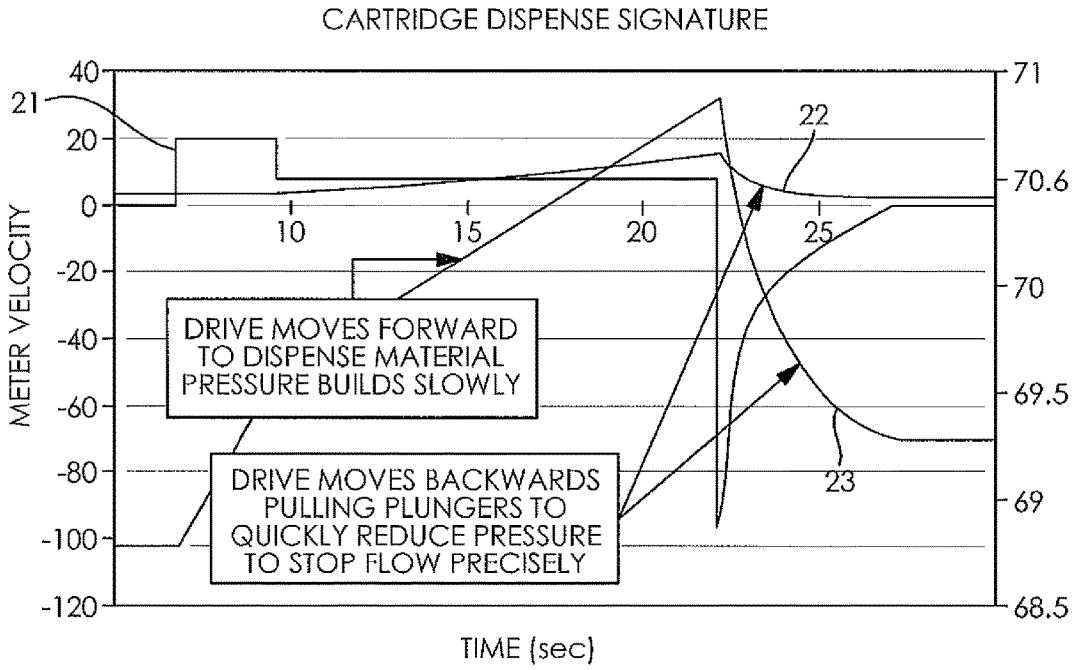
FIG. 5 is a graph of meter velocity, dispense pressure and meter position during cartridge dispensing wherein the drive moves backwards at a dispensing stop.

FIG. 5 is a graph of meter velocity, dispense pressure and meter position during cartridge dispensing wherein the drive moves backwards at a dispensing stop. A line 21 represents dispense meter velocity versus time. A line 22 represents dispense pressure versus time and a line 23 represents meter position (percent) versus time. The servo actuator 2 drives forward to dispense the material and the dispense pressure builds slowly (line 23). The servo actuator 2 moves backwards to pull the cartridge plunger back and quickly reduce pressure to precisely stop the flow of material from the cartridge (lines 22 and 23 between 20 and 25 seconds).

Figure 6:
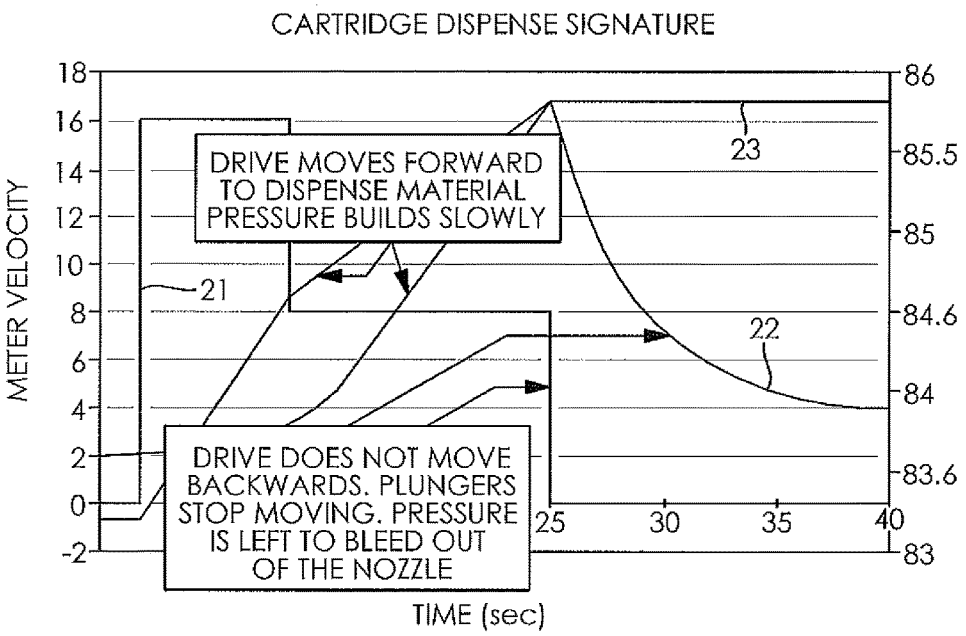
FIG. 6 is a graph of meter velocity, dispense pressure and meter position during cartridge dispensing wherein the drive does not move backwards at a dispensing stop.

FIG. 6 is a graph of meter velocity, dispense pressure and meter position during cartridge dispensing wherein the drive does not move backwards at a dispensing stop. The servo actuator 2 drives forward to dispense the material and the dispense pressure builds slowly (lines 22 and 23). The servo actuator 2 does not move backwards and the cartridge plunger stops moving such that the pressure bleeds out of the nozzle 7 to the flow of material from the cartridge (lines 21, 22 and 23 between 25 and 40 seconds).

Figure 7:
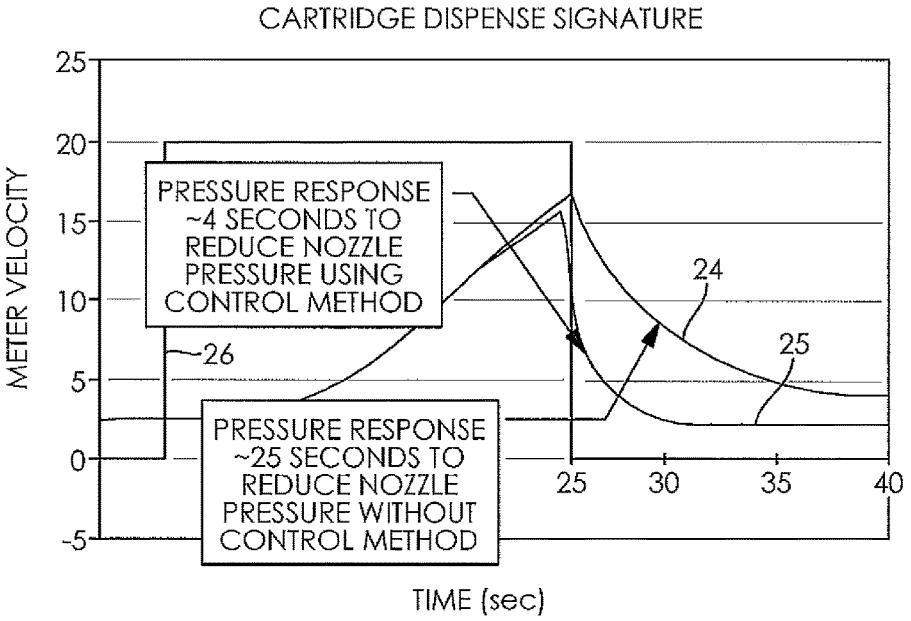
FIG. 7 is a graph of dispense pressure without the control method according to the invention, dispense pressure using the method and dispensing from the cartridge.

FIG. 7 is a graph of dispense pressure without the control method according to the invention, dispense pressure using the method and dispensing from the cartridge. Line 24 represents the dispense pressure versus time without using the control method according to the invention wherein approximately 25 seconds are required to reduce the nozzle pressure. Line 25 represents the dispense pressure versus time using the control method according to the invention wherein approximately only 4 seconds are required to reduce the nozzle pressure. Line 26 represents the meter velocity versus time during the dispensing operation wherein the servo actuator 2 is stopped at approximately 25 seconds.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A system for applying sealant material from a cartridge comprising:

a cartridge fixture storing:

a plurality of cartridges each including unique identification information and containing sealant material, said cartridge fixture monitoring and controlling the temperature of the cartridges while in the fixture; and a plurality of nozzles;

a cartridge robot for removing a selected one of the cartridges from the fixture and for removing a selected one of the nozzles from the fixture;

a dispense robot for receiving the selected cartridge from the cartridge robot, receiving the selected nozzle from the cartridge robot, and applying the sealant material contained therein through the nozzle to a workpiece;

a controller connected to the cartridge robot and the dispense robot for operating the robots, said controller determining a time that each of the plurality of cartridges has been in the fixture, said controller recording the time that the cartridges have been in the fixture and the temperature of the cartridges while in the fixture; and a sensor connected to the controller for generating the unique identification information for the selected cartridge to the controller for automated handling of the cartridge based upon the unique identification information.

2. The system for applying sealant material according to claim 1 wherein the sensor is a vision sensor associated with the cartridge robot and connected to the controller for generating the unique identification information from a bar code on the selected cartridge.

3. The system for applying sealant material according to claim 1 including a vision sensor associated with the dispense robot and connected to the controller for at least one of inspecting the nozzle through which the sealant material is applied and finding the workpiece.

4. The system for applying sealant material according to claim 1 including at least one other sensor connected to the controller for generating at least one of sealant usage per workpiece, sealant dispense pressure, sealant dispense temperature, and sealant usage from the selected cartridge for the automated handling by the controller.

5. The system for applying sealant material according to claim 4 wherein the at least one other sensor includes a cartridge plunger actuator associated with the dispense robot and connected to the controller for generating the sealant usage per workpiece and sealant usage from the selected cartridge.

6. The system for applying sealant material according to claim 4 wherein the at least one other sensor is a pressure sensor associated with the dispense robot and connected to the controller for generating the sealant dispense pressure during application of the sealant material.

7. The system for applying sealant material according to claim 4 wherein the at least one other sensor is a temperature sensor connected to the controller and associated with at least one of the cartridge fixture, for generating a temperature of the sealant material in the cartridges, and the dispense robot, for generating the sealant dispense temperature.

8. The system for applying sealant material according to claim 1 wherein the dispense robot includes a cartridge holder movable between an open position for receiving the selected cartridge from the cartridge robot and a closed position for applying the sealant material.

9. The system for applying sealant material according to claim 1 wherein the dispense robot includes a pressure sensing manifold for connecting the selected cartridge to the nozzle for applying the sealant material.

10. A method for applying sealant material from a cartridge comprising the steps of:

storing in a cartridge fixture:

a plurality of cartridges each including unique identification information and containing sealant material, said cartridge fixture monitoring and controlling the temperature of the cartridges while in the fixture; and a plurality of nozzles;

operating a cartridge robot to remove a selected one of the cartridges from the fixture and to remove a selected one of the nozzles from the fixture;

operating a dispense robot to receive the selected cartridge from the cartridge robot, to receive the selected nozzle from the cartridge robot, and apply the sealant material contained therein through the nozzle to a workpiece;

providing a controller connected to the cartridge robot and the dispense robot for operating the robots, said controller determining a time that each of the plurality of cartridges has been in the fixture, said controller recording the time that the cartridges have been in the fixture and the temperature of the cartridges while in the fixture; and generating from a sensor connected to the controller the unique identification information for the selected cartridge to the controller for automated handling of the cartridge based upon the unique identification information.

11. The method for applying sealant material according to claim 10 including generating from at least one other sensor connected to the controller at least one of sealant usage per workpiece, sealant dispense pressure, sealant dispense temperature, and sealant usage from the selected cartridge for the automated handling by the controller.

12. The method for applying sealant material according to claim 10 including keeping records of each cartridge used to apply the sealant material, each application of the sealant material and each part sealed with the sealant material.

13. The method for applying sealant material according to claim 10 including operating the dispense robot to inspect the sealant material application and provide at least one of inspection results and inspection images for record keeping.

14. A system for applying sealant material from a cartridge comprising:

a cartridge fixture storing:

a plurality of cartridges each including unique identification information and containing sealant material; and a plurality of nozzles;

a cartridge robot for removing a selected one of the cartridges from the fixture and for removing a selected one of the nozzles from the fixture;

a dispense robot for receiving the selected cartridge from the cartridge robot, receiving the selected nozzle from the cartridge robot, and applying the sealant material contained therein through the nozzle to a workpiece, said dispense robot including a servo actuator that operates to push a plunger to dispense the sealant material from the cartridges;

a controller connected to the cartridge robot and the dispense robot for operating the robots, wherein the controller controls dispensing of the sealant material from the cartridges based on a speed of the servo actuator, and a sensor connected to the controller for generating the unique identification information for the selected cartridge to the controller for automated handling of the cartridge based upon the unique identification information.

15. The system according to claim 1 wherein the dispense robot includes a servo actuator that operates to push a plunger to dispense the sealant material from the cartridges, and wherein the controller controls dispensing of the sealant material from the cartridges based on a speed of the servo actuator.

16. The method according to claim 10 wherein the dispense robot includes a servo actuator that operates to push a plunger to dispense the sealant material from the cartridges, and wherein the controller controls dispensing of the sealant material from the cartridges based on a speed of the servo actuator.

* * * * *